US010950400B2

(12) United States Patent
Zhang et al.

(10) Patent No.: US 10,950,400 B2
(45) Date of Patent: Mar. 16, 2021

(54) ELECTRIC CONTACT SYSTEM

(71) Applicant: Tyco Electronics (Shenzhen) Co. Ltd, Shenzhen (CN)

(72) Inventors: Xiaoning Zhang, Shenzhen (CN); Teng Zou, Shenzhen (CN)

(73) Assignee: Tyco Electronics (Shenzhen) Co. Ltd, Shenzhen (CN)

( * ) Notice: Subject to any disclaimer, the term of this patent is extended or adjusted under 35 U.S.C. 154(b) by 0 days.

(21) Appl. No.: 16/702,990

(22) Filed: Dec. 4, 2019

(65) Prior Publication Data

US 2020/0105484 A1 Apr. 2, 2020

Related U.S. Application Data

(63) Continuation of application No. PCT/EP2018/064388, filed on May 31, 2018.

(30) Foreign Application Priority Data

Jun. 5, 2017 (CN) ..... 201710413442

(51) Int. Cl.
*H01H 33/02* (2006.01)

(52) U.S. Cl.
CPC ..... *H01H 33/025* (2013.01); *H01H 2205/002* (2013.01)

(58) Field of Classification Search
CPC ..... H01H 33/025; H01H 33/06; H01H 3/40; H01H 73/045; H01H 73/18; H01H 9/32;
(Continued)

(56) References Cited

U.S. PATENT DOCUMENTS 4,647,741 A * 3/1987 Belbel ..... H01H 9/32 218/117
4,801,772 A * 1/1989 Bratkowski ..... H01H 9/32 218/117

(Continued)

FOREIGN PATENT DOCUMENTS

DE 29516057 U1 1/1996
DE 19915010 A1 7/2001

(Continued)

OTHER PUBLICATIONS

Translation DE29516057 (Original document published Dec. 7, 1995) (Year: 1995).*

(Continued)

*Primary Examiner* — William A Bolton
(74) *Attorney, Agent, or Firm* — Barley Snyder

(57) ABSTRACT

An electric contact system includes a moving member movable in a vertical direction, a movable contact mounted on and moved with the moving member, a static contact, and an arc extinguishing device including a movable bracket movable in a horizontal direction and an arc extinguishing sheet mounted on and movable with the movable bracket. The movable contact moves between a switch-on position and a switch-off position. When the movable bracket is moved to a first position, the arc extinguishing sheet is moved beyond a contact area between the movable contact and the static contact and allows the movable contact to electrically contact the static contact. When the movable bracket is moved to a second position, the arc extinguishing sheet is moved into the contact area between the movable contact and the static contact to electrically isolate the movable contact from the static contact.

17 Claims, 3 Drawing Sheets

(58) Field of Classification Search
CPC ..... H01H 2009/305; H01H 2205/002; H01H 3/46; H01H 3/32
USPC ... 218/154, 147, 146, 117, 77, 113, 107, 81; 200/50.08, 50.22; 335/14, 16
See application file for complete search history.

(56) References Cited

U.S. PATENT DOCUMENTS 4,849,591 A * 7/1989 Comtois ..... H01H 3/60 218/117
4,880,948 A * 11/1989 Kandatsu ..... H01H 9/32 218/117
4,943,691 A * 7/1990 Mertz ..... H01H 9/32 218/117
6,084,193 A * 7/2000 Pellon ..... H01H 9/32 218/117
8,686,311 B2 * 4/2014 Vigouroux ..... H01H 71/526 218/147

FOREIGN PATENT DOCUMENTS

EP 0299401 A1 1/1989
EP 2784795 A1 10/2014

OTHER PUBLICATIONS

Translation DE19915010 (original document published Jul. 26, 2001) (Year: 2001).*
PCT Notification, The International Search Report and the Written Opinion of the International Searching Authority, Intl Appl No. PCT/EP2018/064388, dated Aug. 17, 2018, 12 pages.
Abstract of EP2784795, dated Oct. 1, 2014, 1 page.
Abstract of EP0299401, dated Jan. 18, 1989, 2 pages.
Abstract of DE19915010, dated Jul. 26, 2001, 1 page.

* cited by examiner

ELECTRIC CONTACT SYSTEM

CROSS-REFERENCE TO RELATED APPLICATIONS

This application is a continuation of PCT International Application No. PCT/EP2018/064388, filed on May 31, 2018, which claims priority under 35 U.S.C. § 119 to Chinese Patent Application No. 2017104134422, filed on Jun. 5, 2017.

FIELD OF THE INVENTION

The present invention relates to an electric contact system and, more particularly, to an electric contact system with an arc extinguishing device.

BACKGROUND

An electrical contact in an electric switch device and a control appliance may discharge and generate an electric arc during switching on to off or off to on. The generation of the electric arc may delay connection and disconnection of an electric circuit and even burn the electrical contacts, resulting in the melting and welding of the electrical contacts. In a severe case, it may cause ignition and explosion of the electric switch device. Therefore, an arc extinguishing device needs to be designed to achieve an efficient and reliable arc extinguishing effect.

An electric switch device, such as a high-voltage direct current relay, usually uses a sealed inflatable magnetic field to lengthen a metal phase electric arc laterally, so that the electric arc may be cooled and deionized rapidly in an arc extinguishing medium. Such a method has a good arc extinguishing effect, but the manufacturing process thereof is complex, which results in a high cost. Another kind of arc extinguishing device is configured to blow the electric arc to a metal grid plate by magnetic blowing, and the electric arc is cut into several segments of short electric arcs by the metal grid plate, which enhances an initial dielectric strength of a gap between the segments of short electric arcs. In addition, the metal grid plate improves the cooling effect and the surface deionization effect. However, the arc extinguishing speed of this arc extinguishing device is not ideal.

SUMMARY

An electric contact system includes a moving member movable in a vertical direction, a movable contact mounted on and moved with the moving member, a static contact, and an arc extinguishing device including a movable bracket movable in a horizontal direction and an arc extinguishing sheet mounted on and movable with the movable bracket. The movable contact moves between a switch-on position and a switch-off position. The movable bracket is moved by the moving member between a first position and a second position when the movable contact is moved. When the movable bracket is moved to the first position, the arc extinguishing sheet is moved beyond a contact area between the movable contact and the static contact and allows the movable contact to electrically contact the static contact. When the movable bracket is moved to the second position, the arc extinguishing sheet is moved into the contact area between the movable contact and the static contact to electrically isolate the movable contact from the static contact.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
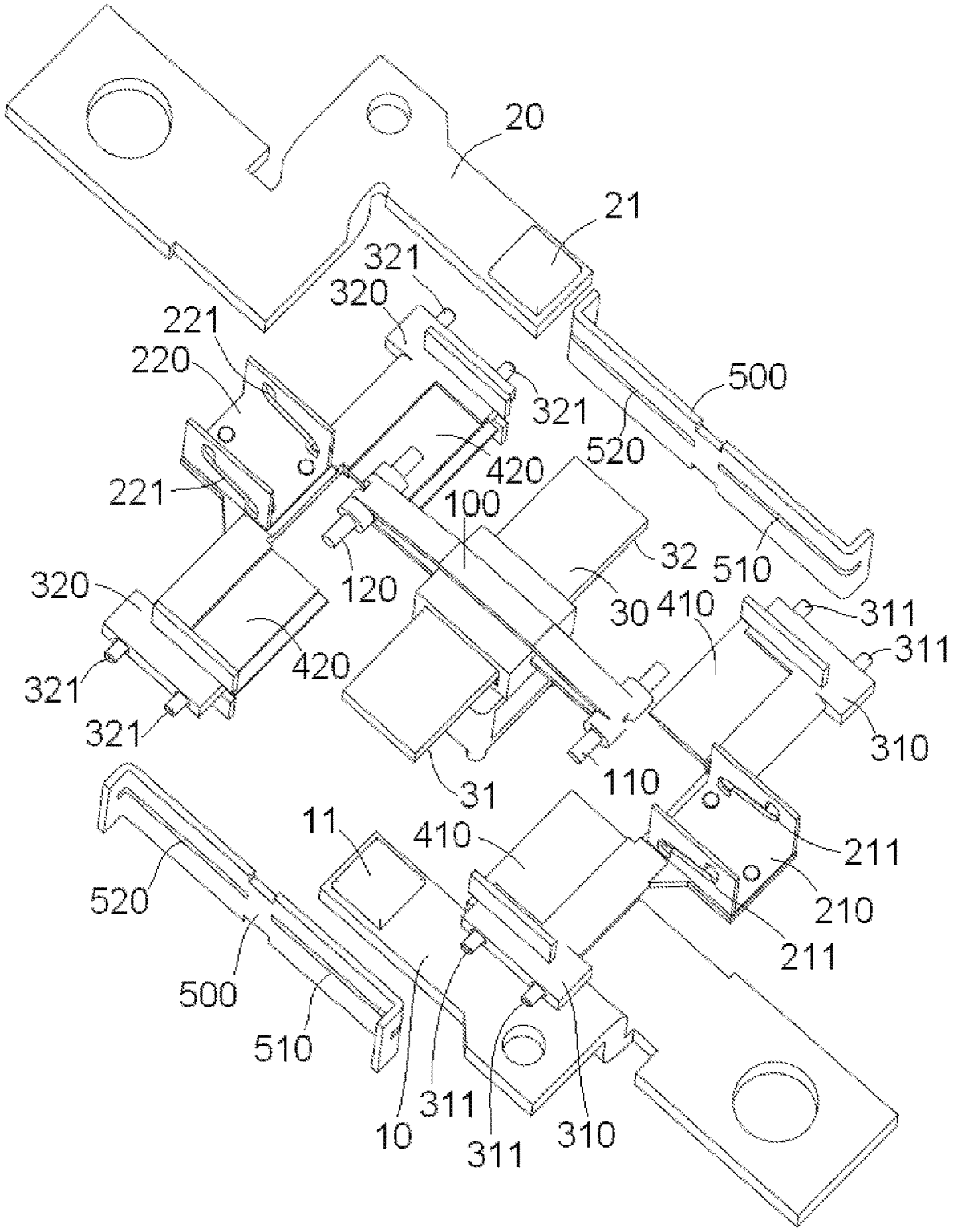
FIG. 1 is an exploded perspective view of an electric contact system according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
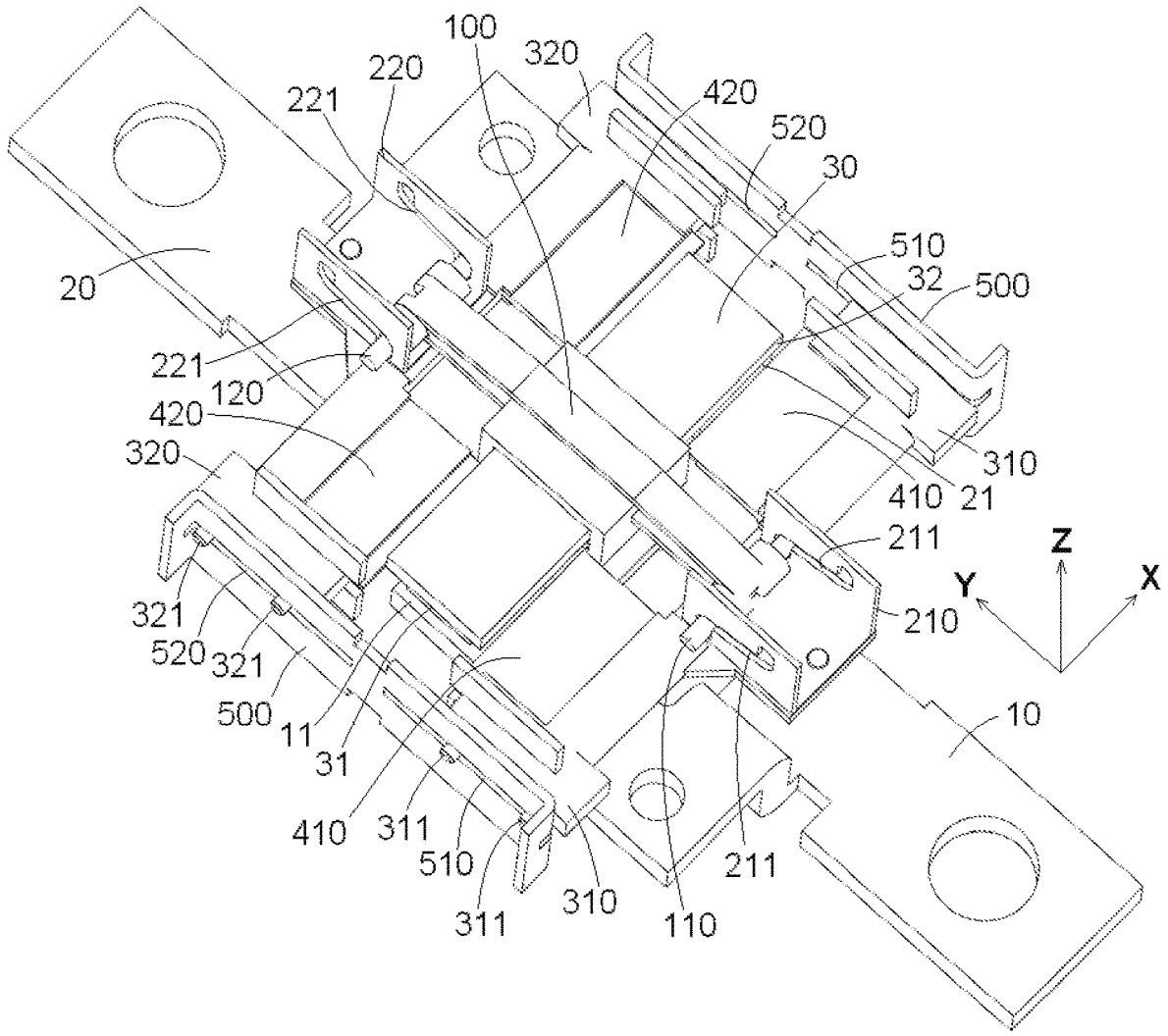
FIG. 2 is a perspective view of the electric contact system in which a movable contact is in a switch-on position in electrical contact with a static contact.
Figure 3:
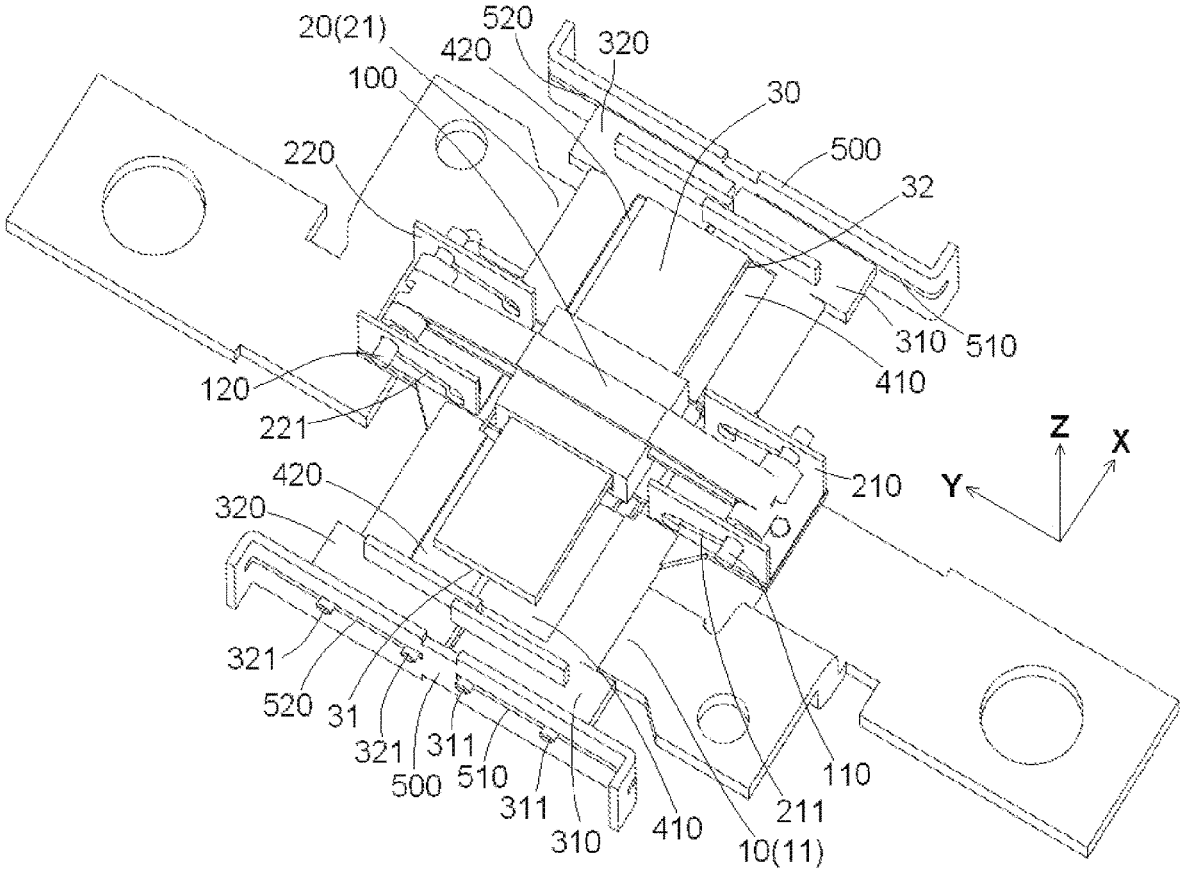
FIG. 3 is a perspective view of the electric contact system in which the movable contact is in a switch-off position separated from the static contact.

An electric contact system according to an embodiment, as shown in FIGS. 1-3, is mounted on a seat and comprises a moving member 100, a movable contact 30, and a static contact 10, 20. The moving member 100 is movable in a vertical direction Z. The movable contact 30 is mounted on the moving member 100 to be moved in the vertical direction Z with the moving member 100. The movable contact 30 may be moved by the moving member 100 between a switch-on position, shown in FIG. 2, in which the movable contact 30 is in electrical contact with the static contact 10, 20, and an switch-off position, shown in FIG. 3, in which the movable contact 30 is separated from the static contact 10, 20.

The electric contact system, as shown in FIGS. 1-3, includes an arc extinguishing device. The arc extinguishing device includes a movable bracket 210, 220, 310, 320 and an arc extinguishing sheet 410, 420. The movable bracket 210, 220, 310, 320 is movable in a horizontal direction Y perpendicular to the vertical direction Z with respect to the seat. The arc extinguishing sheet 410, 420 is mounted on the movable bracket and movable in the horizontal direction Y with the movable bracket 210, 220, 310, 320 with respect to the seat. When the moving member 100 is driven to move in the vertical direction Z, the movable contact 30 is moved by the moving member 100 between the switch-on position and the switch-off position in the vertical direction Z with respect to the seat, while the movable bracket 210, 220, 310, 320 is moved by the moving member 100 between a first position and a second position in the horizontal direction Y.

When the movable bracket 210, 220, 310, 320 is moved to the first position shown in FIG. 2, the arc extinguishing sheet 410, 420 is moved beyond a contact area between the movable contact 30 and the static contact 10, 20 in the horizontal direction Y, so as to allow the movable contact 30 to be in electrical contact with the static contact 10, 20. When the movable bracket 210, 220, 310, 320 is moved to the second position shown in FIG. 3, the arc extinguishing sheet 410, 420 is moved into the contact area between the movable contact 30 and the static contact 10, 20, so as to electrically isolate the movable contact 30 from the static contact 10, 20 and cut off an electric arc between the movable contact 30 and the static contact 10, 20.

As shown in FIGS. 1-3, a slot 221 is obliquely formed in the movable bracket 210, 220, 310, 320, a connection shaft 110, 120 is provided on the moving member 100, and an end of the connection shaft 110, 120 is slidably supported in the slot 221. When the moving member 100 is driven to move the movable contact 30 between the switch-on position and the switch-off position in the vertical direction Z, the connection shaft 110, 120 on the moving member 100 slides in the slot 221, and pushes the movable bracket 210, 220, 310, 320 to move between the first position and the second position in the horizontal direction Y. The slot 221 is formed as an inclined slot with an angle with respect to the horizontal direction Y, and the slot 221 has an upper end and a lower end located at a position lower than the upper end in the vertical direction Z.

As shown in FIG. 2, when moving member 100 is driven to move the movable contact 30 to the switch-on position, the movable bracket 210, 220, 310, 320 is moved to the first position by the moving member 100, and the connection shaft 110, 120 on the moving member 100 slides to the lower end of the slot 221.

As shown in FIG. 3, when moving member 100 is driven to move the movable contact 30 to the switch-off position, the movable bracket 210, 220, 310, 320 is moved to the second position by the moving member 100, and the connection shaft 110, 120 on the moving member 100 slides to the upper end of the slot 221.

The electric contact system, as shown in FIGS. 1-3, comprises a pair of support plates 500 fixed on the seat. The movable bracket 210, 220, 310, 320 is slidably supported on the pair of support plates 500 and is slidable in the horizontal direction Y. The pair of support plates 500 are located at both sides of the movable bracket 210, 220, 310, 320, and a sliding slot 510, 520 extending in the horizontal direction Y is formed in each of the pair of support plates 500. A connecting shaft 311, 321 is provided on each side of the movable bracket 210, 220, 310, 320, and an end of the connecting shaft 311, 321 is slidably supported in the sliding slot 510, 520. In this way, the movable bracket 210, 220, 310, 320 may be moved in the horizontal direction Y by the connecting shaft 311, 321.

The movable bracket 210, 220, 310, 320, as shown in FIGS. 1-3, includes a first movable bracket 210, 310 and a second movable bracket 220, 320. The arc extinguishing sheet 410, 420 has a first arc extinguishing sheet 410 mounted on the first movable bracket 210, 310 and a second arc extinguishing sheet 420 mounted on the second movable bracket 220, 320. The slot 211, 221 has a first slot 211 formed in the first movable bracket 210, 310 and a second slot 221 formed in the second movable bracket 220, 320. The connection shaft 110, 120 has a first connection shaft 110 slidably supported in the first slot 211 and a second connection shaft 110 slidably supported in the second slot 221. The moving member 100 drives the first movable bracket 210, 310 and the second movable bracket 210, 310 to move at the same time by the first connection shaft 110 and the second connection shaft 120 in the horizontal direction Y.

As shown in FIG. 2, when the movable contact 30 is driven to move to the switch-on position, the first arc extinguishing sheet 410 and the second arc extinguishing sheets 420 are moved beyond the contact area between the movable contact 30 and the static contact 10, 20, so as to allow the movable contact 30 to electrically contact the static contact 10, 20. As shown in FIG. 3, when the movable contact 30 is driven to move to the switch-off position, the first arc extinguishing sheet 410 and the second arc extinguishing sheets 420 are moved into the contact area between the movable contact 30 and the static contact 10, 20, so as to electrically isolate the movable contact 30 from the static contact 10, 20 and cut off the electric arc between the movable contact 30 and the static contact 10, 20.

The sliding slot 510, 520, as shown in FIGS. 1-3, includes a first sliding slot 510 and a second sliding slot 520 formed in the support plate 500. The connecting shaft 311, 321 includes a first connecting shaft 311 provided on the first movable bracket 210, 310 and a second connection shaft 321 provided on the second movable bracket 220, 320. An end of the first connecting shaft 311 is slidably supported in the first sliding slot 510, and an end of the second connecting shaft 321 is slidably supported in the second sliding slot 520.

When the moving member 100 moves the movable contact 30 from the switch-on position to the switch-off position, the first arc extinguishing sheet 410 and the second arc extinguishing sheets 420 are moved into the contact area between the movable contact 30 and the static contact 10, 20 from both sides of the contact area, respectively, in the horizontal direction Y by the moving member 100, so as to cut off the electric arc between the movable contact 30 and the static contact 10, 20. When the moving member 100 moves the movable contact 30 from the switch-off position to the switch-on position, the first arc extinguishing sheet 410 and the second arc extinguishing sheets 420 are moved out of the contact area between the movable contact 30 and the static contact 10, 20 from both sides of the contact area, respectively, in the horizontal direction Y by the moving member 100, so as to allow the movable contact 30 to electrically contact the static contact 10, 20.

As shown in FIG. 3, when the movable contact 30 is moved to the switch-off position, an inner side edge of the first arc extinguishing sheet 410 contacts or is adjacent to an inner side edge of the second arc extinguishing sheet 420, so as to cut off the electric arc between the movable contact 30 and the static contact 10, 20.

The first movable bracket 210, 310, as shown in FIGS. 1-3, includes a first guiding member 210 and a first supporting member 310 connected to the first guiding member 210. The first slot 211 is formed in the first guiding member 210, and the first arc extinguishing sheet 410 is mounted on the first supporting member 310. The first connecting shaft 311 is provided on the first supporting member 310. The first guiding member 210 includes a pair of first vertical sidewalls in each of which the first slot 211 is formed.

The second movable bracket 220, 320, as shown in FIGS. 1-3, includes a second guiding member 220 and a second supporting member 320 connected to the second guiding member 220. The second slot 221 is formed in the second guiding member 220, and the second arc extinguishing sheet 420 is mounted on the second supporting member 320. The second connecting shaft 321 is provided on the second supporting member 320. The second guiding member 220 includes a pair of second vertical sidewalls in each of which the second slot 221 is formed.

In an embodiment, the arc extinguishing sheet 410, 420 may be made of an insulating ceramic material. The first supporting member 310 and the second supporting member 320 may be made of an insulating plastic material, so as to save the cost. In this embodiment, the first supporting member 310 and the second supporting member 320 may be connected to the first guiding member 210 and the second guiding member 220 by plastic hot riveting, respectively. The first arc extinguishing sheet 410 and the second arc extinguishing sheet 420 may be embedded in the first supporting member 310 and the second supporting member 320, respectively. In another embodiment, the first supporting member 310 and the second supporting member 320 may be molded on the first arc extinguishing sheet 410 and the second arc extinguishing sheet 420, respectively.

The static contact 10, 20 fixed on the seat, as shown in FIGS. 1-3, has a first static contact 10 formed with a first static contact point 11 and a second static contact 20 formed with a second static contact point 21. A first movable contact point 31 adapted to electrically contact the first static contact point 11 is formed on a first end of the movable contact 30, and a second movable contact point 32 adapted to electrically contact the second static contact point 21 is formed on a second end of the movable contact 30. As shown in FIG. 2, when the movable contact 30 is moved to the switch-on position, the first movable contact point 31 and the second movable contact point 32 electrically contact the first static contact point 11 and the second static contact point 21, respectively. As shown in FIG. 3, when the movable contact 30 is moved to the switch-off position, the first movable contact point 31 and the second movable contact point 32 are separated from the first static contact point 11 and the second static contact point 21, respectively.

In the disclosed embodiments, the arc extinguishing sheet 410, 420 may be quickly moved into the contact area between the movable contact 30 and the static contact 10, 20. Thereby, the electric arc between the movable contact 30 and the static contact 10, 20 may be quickly cut off, achieving an efficient and reliable arc extinguishing effect. In addition, the electrical contact system is simple to manufacture, reducing cost.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electric contact system, comprising:

a moving member movable in a vertical direction;

a movable contact mounted on the moving member and moved in the vertical direction with the moving member;

a static contact, the movable contact moves between a switch-on position in which the movable contact is in electrical contact with the static contact and a switch-off position in which the movable contact is separated from the static contact;

an arc extinguishing device including a movable bracket movable in a horizontal direction perpendicular to the vertical direction and an arc extinguishing sheet mounted on the movable bracket and movable in the horizontal direction with the movable bracket, the movable bracket is moved by the moving member between a first position and a second position when the movable contact is moved between the switch-on position and the switch-off position, when the movable bracket is moved to the first position the arc extinguishing sheet is moved beyond a contact area between the movable contact and the static contact and allows the movable contact to electrically contact the static contact, and when the movable bracket is moved to the second position, the arc extinguishing sheet is moved into the contact area between the movable contact and the static contact to electrically isolate the movable contact from the static contact, the movable bracket has a slot and the moving member has a connection shaft, an end of the connection shaft is slidably supported in the slot, when the moving member moves the movable contact between the switch-on position and the switch-off position, the connection shaft slides in the slot and pushes the movable bracket to move between the first position and the second position; and a pair of support plates on which the movable bracket is slidably supported to be slidable in the horizontal direction, the pair of support plates are located at opposite sides of the movable bracket, a sliding slot extending in the horizontal direction is formed in each of the pair of support plates, the movable bracket has a connecting shaft on each side of the movable bracket and an end of the connecting shaft is slidably supported in the sliding slot.

2. The electric contact system of claim 1, wherein the slot is an inclined slot with an angle with respect to the horizontal direction, the slot has an upper end and a lower end located at a position lower than the upper end in the vertical direction.

3. The electric contact system of claim 2, wherein, when moving member moves the movable contact to the switch-on position, the movable bracket is moved to the first position by the moving member and the connection shaft slides to the lower end of the slot, and when moving member moves the movable contact to the switch-off position, the movable bracket is moved to the second position by the moving member and the connection shaft slides to the upper end of the slot.

4. The electric contact system of claim 1, wherein the movable bracket has a first movable bracket and a second movable bracket, the arc extinguishing sheet has a first arc extinguishing sheet mounted on the first movable bracket and a second arc extinguishing sheet mounted on the second movable bracket, the slot has a first slot formed in the first movable bracket and a second slot formed in the second movable bracket, and the connection shaft has a first connection shaft slidably supported in the first slot and a second connection shaft slidably supported in the second slot.

5. The electric contact system of claim 4, wherein the moving member drives the first movable bracket and the second movable bracket to move simultaneously by the first connection shaft and the second connection shaft.

6. The electric contact system of claim 5, wherein, when the movable contact is moved to the switch-on position, the first arc extinguishing sheet and the second arc extinguishing sheet are moved beyond the contact area between the movable contact and the static contact.

7. The electric contact system of claim 6, wherein, when the movable contact is moved to the switch-off position, the first arc extinguishing sheet and the second arc extinguishing sheet are moved into the contact area between the movable contact and the static contact, so as to electrically isolate the movable contact from the static contact.

8. The electric contact system of claim 7, wherein the sliding slot has a first sliding slot and a second sliding slot in each of the support plates, the connecting shaft has a first connecting shaft disposed on the first movable bracket and a second connection shaft disposed on the second movable bracket, an end of the first connecting shaft is slidably supported in the first sliding slot and an end of the second connecting shaft is slidably supported in the second sliding slot.

9. The electric contact system of claim 8, wherein the first movable bracket has a first guiding member and a first supporting member connected to the first guiding member, the first slot is formed in the first guiding member, the first arc extinguishing sheet is mounted on the first supporting member, and the first connecting shaft is disposed on the first supporting member.

10. The electric contact system of claim 9, wherein the second movable bracket has a second guiding member and a second supporting member connected to the second guiding member, the second slot is formed in the second guiding member, the second arc extinguishing sheet is mounted on the second supporting member, and the second connecting shaft is disposed on the second supporting member.

11. The electric contact system of claim 10, wherein the first guiding member has a pair of first vertical sidewalls in each of which the first slot is formed, and the second guiding member has a pair of second vertical sidewalls in each of which the second slot is formed.

12. The electric contact system of claim 7, wherein, when the moving member moves the movable contact from the switch-on position to the switch-off position, the first arc extinguishing sheet and the second arc extinguishing sheet are moved into the contact area between the movable contact and the static contact from both sides of the contact area by the moving member.

13. The electric contact system of claim 12, wherein, when the movable contact is moved to the switch-off position, an inner side edge of the first arc extinguishing sheet contacts or is adjacent to an inner side edge of the second arc extinguishing sheet.

14. The electric contact system of claim 7, wherein, when the moving member moves the movable contact from the switch-off position to the switch-on position, the first arc extinguishing sheet and the second arc extinguishing sheet are moved out of the contact area between the movable contact and the static contact from both sides of the contact area by the moving member.

15. The electric contact system of claim 1, wherein the static contact has a first static contact with a first static contact point and a second static contact with a second static contact point, a first movable contact point adapted to be electrical contact with the first static contact point is formed on a first end of the movable contact and a second movable contact point adapted to be in electrical contact with the second static contact point is formed on a second of the movable contact.

16. The electric contact system of claim 15, wherein when the movable contact is moved to the switch-on position, the first movable contact point and the second movable contact point electrically contact with the first static contact point and the second static contact point, and when the movable contact is moved to the switch-off position, the first movable contact point and the second movable contact point are separated from the first static contact point and the second static contact point.

17. The electric contact system of claim 1, wherein the arc extinguishing sheet is made of an insulating ceramic material.

* * * * *